US006257429B1

(12) United States Patent
Kong

(10) Patent No.: US 6,257,429 B1
(45) Date of Patent: Jul. 10, 2001

(54) DRINK DISPENSER FOR COLLAPSIBLE LIQUID CONTAINERS

(76) Inventor: Carl Cheung Tung Kong, 6122 Whittier Blvd., Los Angeles, CA (US) 90022

( * ) Notice: Subject to any disclaimer, the term of this patent is extended or adjusted under 35 U.S.C. 154(b) by 0 days.

(21) Appl. No.: 09/516,261

(22) Filed: Feb. 29, 2000

Related U.S. Application Data

(63) Continuation-in-part of application No. 09/478,964, filed on Jan. 6, 2000, which is a continuation of application No. 09/037,239, filed on Mar. 9, 1998, now abandoned.

(51) Int. Cl.[7] ..... A61J 9/00; A61J 9/04
(52) U.S. Cl. ..... 215/11.3; 215/11.5; 215/388
(58) Field of Search ..... 215/11.1, 11.3, 215/11.4; 220/8, 366.1

(56) References Cited

U.S. PATENT DOCUMENTS

| | | | | |
|---|---|---|---|---|
| 3,780 | | 10/1844 | Dupy . | |
| 159,197 | | 1/1875 | Mason . | |
| 177,185 | | 5/1876 | Whitney . | |
| 224,557 | | 2/1880 | Potter . | |
| 227,075 | | 4/1880 | Thompson . | |
| 234,224 | | 11/1880 | Barton . | |
| 244,181 | | 7/1881 | Carpenter . | |
| 253,014 | | 1/1882 | Day . | |
| 275,288 | | 4/1883 | Thomas . | |
| 279,935 | | 6/1883 | Glattsteine . | |
| 280,656 | | 7/1883 | Morris . | |
| 323,597 | | 8/1885 | Prime . | |
| 468,759 | | 2/1892 | Bobrick . | |
| 554,071 | * | 2/1896 | Matzen | 215/11.3 |
| 593,830 | | 11/1897 | Borgenschild . | |
| 682,464 | | 9/1901 | Graham-Yooll . | |
| 2,446,451 | * | 8/1948 | Allen | 215/11.3 |
| 2,469,489 | | 5/1949 | Allen et al. . | |
| 2,520,335 | * | 8/1950 | Piazze . | |
| 2,594,114 | | 4/1952 | Baracate . | |

(List continued on next page.)

FOREIGN PATENT DOCUMENTS

| | | | |
|---|---|---|---|
| 874/36 | | 3/1936 | (AU) . |
| 0610669 | * | 9/1926 | (FR) . |
| 2067416 | | 7/1981 | (GB) . |
| 2131301 | | 6/1984 | (GB) . |
| 2181958 | | 5/1987 | (GB) . |
| 2220363 | | 10/1990 | (GB) . |
| 2254999 | | 10/1992 | (GB) . |
| 1699462 | | 9/1989 | (SU) . |

*Primary Examiner*—Allan N. Shoap
*Assistant Examiner*—Tri M. Mai
(74) *Attorney, Agent, or Firm*—Kelly Bauersfeld Lowry & Kelley, LLP

(57) ABSTRACT

A drink dispenser is provided and includes a rigid tubular casing having first and second ends and a flexible bag having an open end attachable to the second end of the casing, the casing and flexible bag cooperatively forming a fluid container. A locking ring engages the second end of the casing for removably securing the flexible bag to the second end of the casing. The rigid casing and flexible bag each define approximately one-half of the fluid capacity of the fluid container. The flexible bag is adapted to extend away from the casing when filled with fluid, and fully collapse into the casing as the fluid is withdrawn from the drink dispenser. A mouthpiece is attachable to the first end of the casing to provide an exit passageway for the fluid within the fluid container. Preferably, the mouthpiece includes a nipple having a one-way valve for preventing air from entering the fluid container. A base is removably snap-fit to the casing so as to encompass the flexible bag. A surface of the casing is contoured to provide an air vent between the casing and the attached base. In another embodiment, the mouthpiece is attached to the casing via an elongated hollow tube which interconnects the mouthpiece to a central flow port of a cap mounted over the casing.

22 Claims, 3 Drawing Sheets

U.S. PATENT DOCUMENTS

| | | | | |
|---|---|---|---|---|
| 2,655,279 | | 10/1953 | Wolf . | |
| 2,680,441 | | 6/1954 | Krammer . | |
| 2,756,740 | | 7/1956 | Deane . | |
| 2,760,664 | | 8/1956 | D'Amico et al. . | |
| 2,767,871 | | 10/1956 | Shapiro . | |
| 2,826,324 | | 3/1958 | Hoag . | |
| 2,836,321 | | 5/1958 | Soltesz et al. . | |
| 2,846,103 | | 8/1958 | Maxwell . | |
| 2,876,113 | * | 3/1959 | Barton . | |
| 2,954,030 | | 9/1960 | Jozwiak . | |
| 3,044,650 | | 7/1962 | Oltion et al. . | |
| 3,059,797 | | 10/1962 | Wilkinson et al. . | |
| 3,065,873 | | 11/1962 | Plate . | |
| 3,071,272 | | 1/1963 | Doner . | |
| 3,076,574 | | 2/1963 | Woodbury, Jr. . | |
| 3,126,116 | | 3/1964 | Clinehens . | |
| 3,134,494 | * | 5/1964 | Quinn . | |
| 3,146,904 | | 9/1964 | Hansen et al. . | |
| 3,171,571 | | 3/1965 | Daniels . | |
| 3,173,566 | | 3/1965 | Talbert . | |
| 3,204,855 | | 9/1965 | Boynton et al. . | |
| 3,232,467 | * | 2/1966 | Barton | 215/11.3 |
| 3,243,069 | | 3/1966 | Duerme . | |
| 3,247,360 | | 4/1966 | Ponder . | |
| 3,334,764 | * | 8/1967 | Fouser | 215/11.1 |
| 3,346,133 | | 10/1967 | Herdman . | |
| 3,406,853 | * | 10/1968 | McLeod . | |
| 3,441,160 | | 4/1969 | Levy . | |
| 3,645,414 | | 2/1972 | Barr . | |
| 3,648,873 | | 3/1972 | Grobbel . | |
| 3,651,973 | * | 3/1972 | Yamauchi | 215/11.3 |
| 3,661,288 | | 5/1972 | Noll . | |
| 3,704,803 | | 12/1972 | Ponder . | |
| 3,770,154 | | 11/1973 | Johnson . | |
| 3,776,408 | * | 12/1973 | Wald | 215/11.3 |
| 3,784,039 | * | 1/1974 | Marco . | |
| 3,946,888 | * | 3/1976 | Tonkin . | |
| 3,955,698 | | 5/1976 | Hammer . | |
| 4,153,170 | | 5/1979 | Aquarian . | |
| 4,241,768 | | 12/1980 | Keller et al. . | |
| 4,301,934 | | 11/1981 | Forestal . | |
| 4,339,046 | | 7/1982 | Coen . | |
| 4,463,859 | | 8/1984 | Greene . | |
| 4,615,457 | | 10/1986 | Harding . | |
| 4,657,151 | | 4/1987 | Cabernoch . | |
| 4,684,032 | | 8/1987 | Tsay . | |
| 4,685,577 | * | 8/1987 | Chen . | |
| 4,726,479 | | 2/1988 | Tsai . | |
| 4,754,887 | | 7/1988 | Ou . | |
| 4,796,767 | | 1/1989 | McKeown . | |
| 4,815,615 | * | 3/1989 | Phlaphongphanich | 215/11.3 |
| 4,821,896 | | 4/1989 | Cheng . | |
| 4,830,226 | | 5/1989 | Kong . | |
| 4,880,125 | | 11/1989 | LeBeau . | |
| 4,898,290 | | 2/1990 | Cueto . | |
| 4,925,042 | | 5/1990 | Chong . | |
| 4,969,564 | | 11/1990 | Cohen et al. . | |
| 4,979,629 | | 12/1990 | Askerneese . | |
| 5,078,287 | * | 1/1992 | Holmes, III . | |
| 5,105,956 | | 4/1992 | Tarng-Lin . | |
| 5,109,996 | | 5/1992 | Sullivan . | |
| 5,211,298 | | 5/1993 | Bloch . | |
| 5,301,825 | | 4/1994 | Di Scala et al. . | |
| 5,699,920 | * | 12/1997 | Ida et al. . | |
| 5,749,483 | * | 5/1998 | Tebeau | 215/11.3 |
| 5,758,787 | * | 6/1998 | Sheu | 215/11.3 |

* cited by examiner

DRINK DISPENSER FOR COLLAPSIBLE LIQUID CONTAINERS

RELATED APPLICATION

This application is a continuation-in-part of application Ser. No. 09/478,964 filed Jan. 6, 2000, which is a continuation of Ser. No. 09/037,239 filed Mar. 9, 1998 now abandoned.

BACKGROUND OF THE INVENTION

This invention relates generally to drink dispensers, including nursing bottles for infants. More specifically, the present invention relates to drink dispensers which incorporate a collapsible plastic container to hold a fluid in the dispenser, and a means for expelling air from the collapsible bag so that only the liquid remains for drinking. Moreover, the present invention relates to an improved mouthpiece or nipple to facilitate suction withdrawal of liquid from the drink dispenser.

Nursing bottles for infants are generally known in the art and typically comprise a resilient nipple mounted onto a cap or neck ring which is adapted in turn for mounting onto a bottle containing a selected beverage or food product in liquid form for an infant. The resilient nipple comprises a soft and collapsible mouthpiece which is manipulated by the infant with an alternating collapsing and expansion motion in combination with a sucking action to draw the liquid contents of the bottle through a nipple port. Nursing bottles of this standard type must be held in an inverted or substantially inverted position during use, to ensure fluid flow communication of the bottle contents to the resilient nipple. Further, such conventional bottles naturally fill with air as the infant drinks the liquid. In turn, the feeding infant tends to swallow some of the air, causing indigestion.

As an improvement on this long existing configuration, a newer generation of baby nursing bottles consists of a polymeric cylinder into which a collapsible disposable plastic bag can be positioned. The milk, formula or other liquid is then added to the bag rather than to the cylinder or bottle itself. When topped with the appropriate nipple assembly, this arrangement desirably provides a system under which the bag gradually collapses as the infant feeds from the liquid therein. Because the bag collapses, there is a lesser tendency for air to enter it as an infant drinks. It is intended that this system help an infant to swallow less air during feeding than the infant would when feeding from a noncollapsible bottle.

Nevertheless, an air content problem remains with such collapsible bag feeding systems in that during normal filling procedures the collapsible bag cannot be filled completely with liquid. In this regard, such baby nursing bottles initially require that air in the chamber formed by the nipple and the liner cavity be expelled manually prior to the start of feeding. One typical and common method of expelling air is for the user to insert his or her fingers into an open end of a shell body and push on the liner until all of the air is expelled and only liquid remains. While air may be expelled in this manner for a full bottle, as the amount of liquid in the bottle diminishes the liner must be pushed further into the shell from the open lower end of the shell body until the user's fingers can no longer reach the liner to compress the liner and liquid contained therein to expel any captured air.

Another common problem generally associated with flexible liner baby nursing bottles is the reentry of air into the liner after the bottle has been put aside, particularly in an upright position such as might be the case when the baby is being burped or otherwise attended to. The weight of the liquid in the liner tends to pull the liner downward drawing air into the liner through the nipple. Air may also be drawn into the liner when the baby stops sucking for a period of time since the vacuum created by the sucking is removed.

Yet another problem associated with flexible liner baby nursing bottles is that when the fluid is removed, the flexible liner collapses upon itself along its longitudinal axis. This increasingly narrows the space available for fluid to flow to the nipple. Small pockets of fluid can be formed within the collapsing liner which are nearly completely closed off from the fluid flow. A significant amount of sucking is required to remove these pockets of fluid from the collapsed liner. When combined with the air inflow discussed above, such new generations bottles may provide little advantage over older systems.

Further a variety of modified nursing bottles have been proposed to include a length of flexible tubing extending between the bottle and the nursing nipple. The flexible tubing effectively spaces the nipple from the bottle, with a view toward permitting consumption of the bottle contents without requiring the bottle to be held by the infant or by an adult. In some instances, the tubing terminates at the bottle cap and thus requires support means of some type for retaining the bottle in an inverted position during use. In other designs, the tubing extends through the bottle cap to a position near the bottom of the bottle, and it is intended that the bottle contents be withdrawn by suction while the bottle remains in an upright position.

The present applicant has discovered that conventional nursing nipples of a soft and collapsible construction are generally unsatisfactory for use in nursing bottles of the type having an elongated suction delivery tube connected between the nipple and the interior of the bottle. That is, as the resilient nipple is alternately collapsed and expanded in such bottle designs, the liquid within the bottle is primarily displaced back and forth within the delivery tube, with a minimal quantity of the liquid reaching the infant for consumption. It is believed that the natural inclination of the infant to the collapse and expansion of the nipple sufficiently disrupts the suction action applied to the delivery tube, whereby little liquid actually reaches the infant in the absence of a significantly increased suction.

In summary, prior drinking dispensers which incorporate a collapsible plastic bag or flexible liner, while presenting numerous advantages over prior nursing bottles, still have disadvantages in their design which require attention. When the drink dispenser is in an upright position and liquid is in the lower part of the flexible/collapsible bag or liner, the upper part of the liner tends to constrict in diameter making it harder to suck liquid out of the bag. Further, as the plastic collapses, it is difficult to tell how much liquid is left in the fluid dispenser or bottle.

Accordingly, there is a need for a simple, straightforward device and drink dispenser construction that permits all of the air to be expelled from the flexible liner and which overcomes the drawbacks noted above. In particular, a fluid dispenser is needed which permits a user to clearly ascertain how much liquid remains in the dispenser (permitting, by easy calculation, how much has been consumed). Moreover, a novel drink dispenser is needed which permits air to be easily expelled from the liner, accommodates prefilled liners to be sold as a unit with the surrounding dispenser, and allows the user to suck liquid easily and smoothly with the drink dispenser in virtually any orientation. With regard to nursing bottles, a need exists for a fluid dispenser having an elongated flow or delivery tube to accommodate versatile bottle positioning relative to a resilient nipple member, while insuring substantial liquid flow of the liquid to the infant in response to a normal suction action. The present invention fulfills these needs and provides other related advantages.

SUMMARY OF THE INVENTION

In accordance with the invention, an improved drink dispenser is provided for facilitating suction-drawn consumption of a beverage or other nutritious liquid therefrom. The drink dispenser is generally comprised of a rigid tubular casing having a first threaded end and a second end and a flexible bag having an open end attachable to the second end of the casing, the casing and flexible bag cooperatively forming a fluid container. A locking ring is threadably engaged with the second end of the casing for removably securing the flexible bag to the end of the casing. The rigid casing and flexible bag each define approximately one-half of the fluid capacity of the fluid container. The flexible bag is adapted to extend away from the casing when filled with fluid, and fully collapse into the casing as the fluid is withdrawn from the drink dispenser.

A mouthpiece is attachable to the first end of the casing to provide an exit passageway for the fluid within the fluid container. Preferably, the mouthpiece includes a nipple having a one-way valve for preventing air from entering the fluid container. Expelling means, typically in the form of exerting pressure upon the flexible bag, is provided for expelling air between the mouthpiece and the fluid.

A base is removably snap-fit to the casing so as to encompass the flexible bag. A surface of the casing is contoured to provide an air vent between the casing and the attached base. At least one aperture extends through a bottom surface of the base to allow heated water to enter the base and uprightly stabilize the drink dispenser when it is placed in a heating bath.

The mouthpiece may be attached to the casing via an elongated hollow tube which interconnects the mouthpiece to a central flow port of a cap mounted over the casing. The hollow tube extends between the cap and the mouthpiece so that the infant can remove fluid from the drink dispenser through the hollow tube while at a distance from the drink dispenser. This embodiment alleviates the necessity of either the parent or the infant having to hold the drink dispenser to the infant's mouth.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 2:
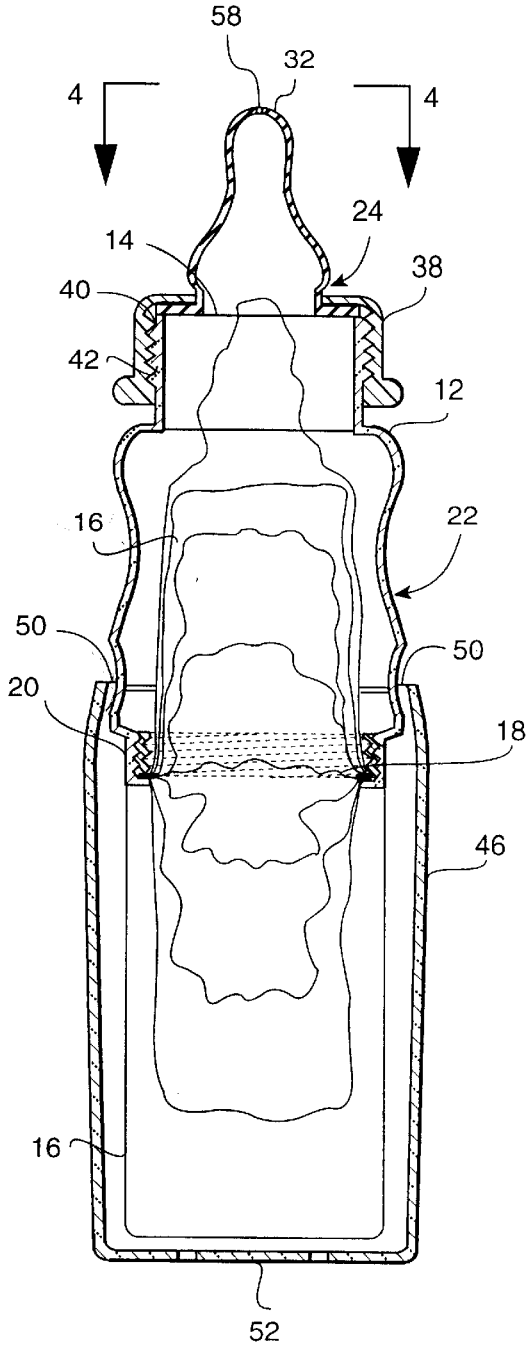
FIG. 2 is a cross-sectional view taken generally along line 2—2 of the drink dispenser of FIG. 1 and illustrating the manner in which a flexible bag connected to a rigid casing extends away from the casing when filled with fluid to be consumed, and collapses fully into the casing as the fluid is withdrawn therefrom.
Figure 3:
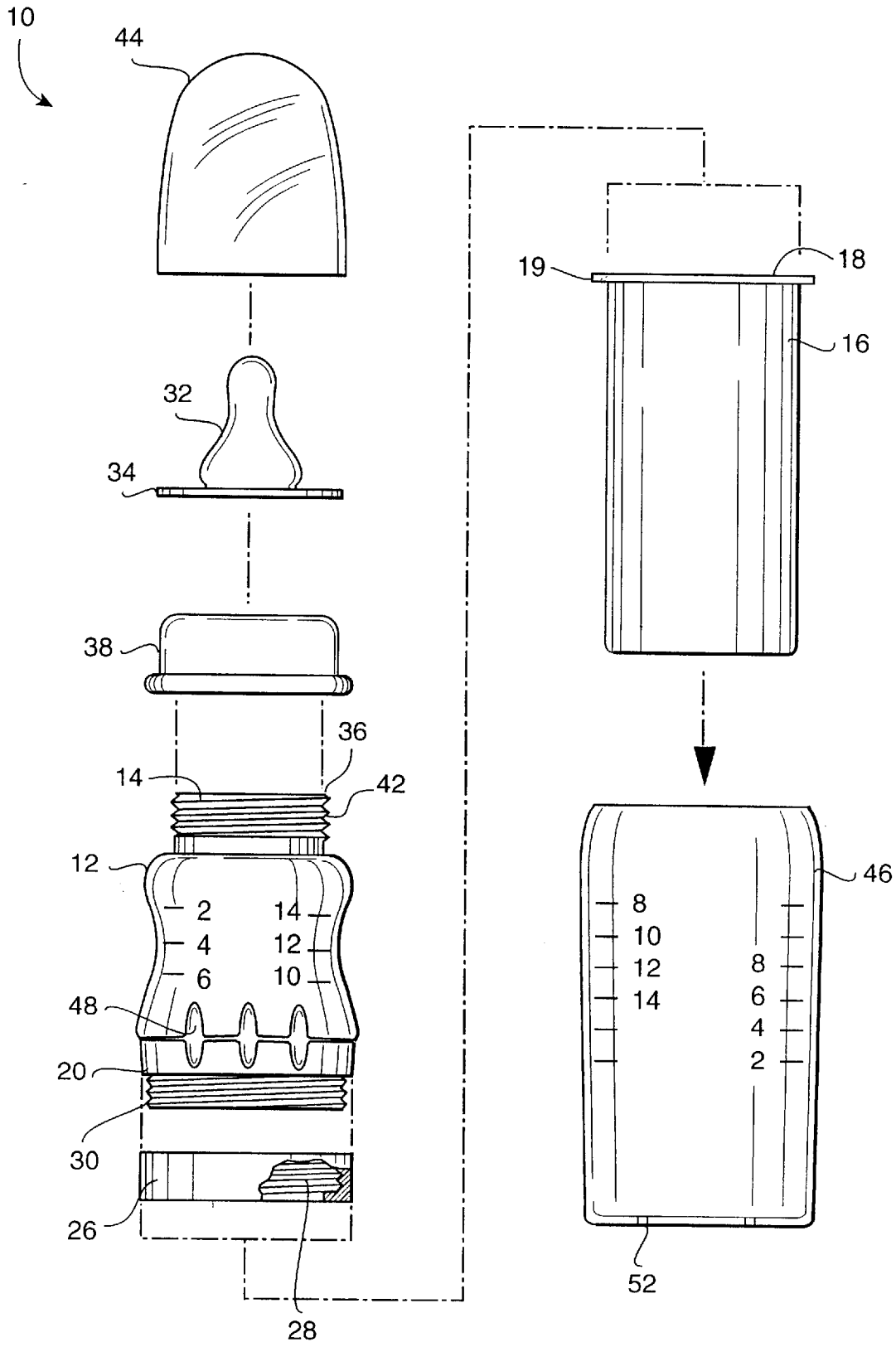
FIG. 3 is an exploded view of the drink dispenser of FIG. 1, illustrating the various components thereof.

As shown in the drawings for purposes of illustration, the present invention is concerned with a drink dispenser 10 comprising, generally, a rigid tubular casing 12 having an upper first opening 14 to permit passage of a fluid to be consumed therethrough, and a flexible bag 16 having an open end 18, defined in FIGS. 2 and 3 by a rigid flange 19, removably secured to a lower second end 20 of the casing 12 opposite the upper opening 14. The generally tubular casing 12 and flexible bag 16 cooperatively define a fluid container 22. Preferably, approximately the upper half of the fluid container 22 is defined by the casing 12 and approximately the lower half of the fluid container 22 is defined by the flexible bag 16 when the flexible bag 16 is filled with fluid and fully extended away from the casing 12. A mouthpiece 24 is sealingly mounted to the upper first end 14 of the casing 12 so as to be in fluid-flow communication with the fluid contained within the fluid container 22.

Figure 1:
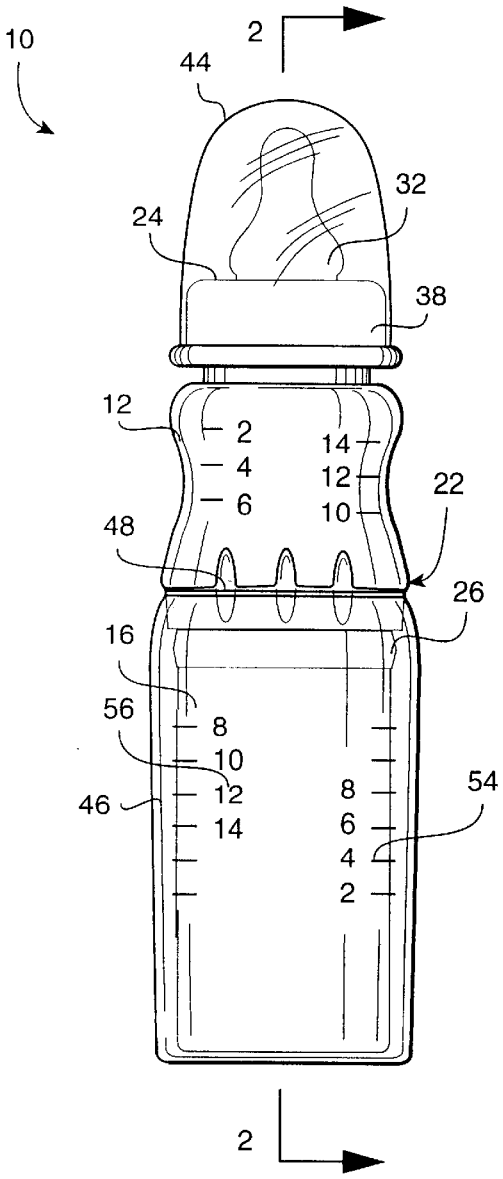
FIG. 1 is an elevational view of a drink dispenser embodying the invention shown in the form of a nursing bottle for infants.

With reference to FIG. 1, a locking ring 26 is positioned over the flexible bag 16 adjacent its open end 18 and mounted to the lower second end of the casing 20 so as to compress and secure the flexible bag 16 to the casing 12 with a tight seal. Although the locking ring 26 can be mounted to the second end 20 of the casing 12 in a variety of ways, preferably, internal threads 28 of the locking ring 26 engage external threads 30 of the lower second end of the casing 20 to secure the flexible bag 16 in place.

As shown in FIGS. 2 and 3, the open end 18 of the flexible bag 16 is alternatively defined by a rigid flange 19 which is sealingly held in place between the lower second end of the casing 20 and the locking ring 26.

In all illustrated embodiments, the flexible bag 16 is comprised of a durable, resilient yet soft and supple material which is adapted to fully extend away from the casing 12 when filled with fluid and collapse towards and eventually within the casing 12 as fluid is removed from the fluid container 22, as illustrated in FIG. 2. Due to the fact that the casing 12 comprises approximately an upper half of the fluid container 22, the flexible bag 16 is capable of fully traveling into the casing 12 as fluid is removed.

The mouthpiece 24 comprises a soft nipple 32 having an extending flange 34 which rests on a rim 36 of the first end of the casing 14 and is compressed in place by a ring 38 which is mounted over the upper first end 14 of the casing 12. Typically, the ring 38 includes internal threads 40 which engage external threads 42 of the first end 14 of the casing 12. When the ring 38 is screwed on tightly to the casing 12, a tight seal between the nipple flange 34 and the rim 36 is created so that fluid cannot escape from the fluid container 22. A lid 44 is configured to snap-fit onto the ring 38 and cover the nipple 32 in order to prevent contact with dirt and other unsanitary objects.

A base 46 is removably attached to the second end 18 of the casing 12 typically by friction snap-fit so as to encompass the flexible bag 16. The casing 12 includes indentations 48 along its surface adjacent the lower second end 20 which create air vents 50 at the interface of the base 46 and the casing 12. These air vents 50 prevent the creation of a vacuum or negative pressure between the base 46 and the flexible bag 16 as fluid is removed from the drink dispenser 10. Apertures 52 extend through the bottom surface of the base 46 so that when the drink dispenser 10 is placed in a heating bath hot water can enter through the base 46 and directly contact the flexible bag 16 to warm the fluid contents thereof. The entry of the water also acts to stabilize the drink dispenser 10 within the bath so that it can stand uprightly. When removed from the heating bath, the warm water quickly flows out of the base 46 through the apertures 52. The air between the base 46 and the flexible bag 16 flows through the air vents 50 as water enters and exits through the apertures 52.

The flexible bag 16, casing 12 and base 46 are preferably transparent or translucent. Two sets of numbers, one ascending and the other descending, 54 and 56 are provided on the exterior of the casing 12 and base 46 and/or flexible bag 16. These numbers 54 and 56 are provided to permit the user of the drink dispenser 10 to ascertain the amount of fluid within the fluid container 22. For example, when filling the fluid container 22 with a fluid to be consumed, the drink dispenser 22 may be held upright and the ascending numbers 54 read to determine the number of fluid ounces within the fluid container 22. Alternatively, or after air and/or fluid has been removed from fluid container 22, the drink dispenser 10 may be inverted and the descending numbers 56 read to determine precisely the amount of fluid to be consumed that remains in the drink dispenser 10.

Figure 4:
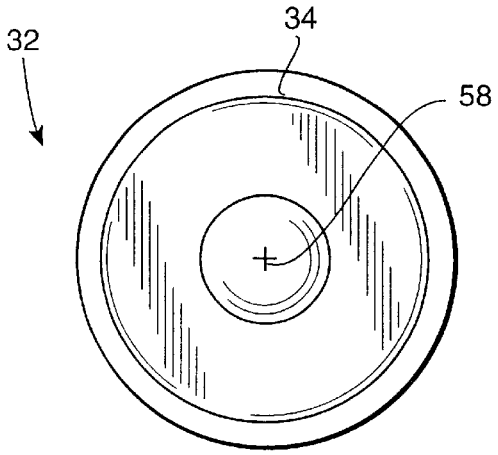
FIG. 4 is a top plan view of the drink dispenser taken generally along the line 4—4 of FIG. 2, illustrating a one-way valve incorporated within a nipple of the drink dispenser.

In use, the mouthpiece 24, comprising the ring 38 and the nipple 32, is removed from the upper end 14 of the casing 48 to expose the opening of the fluid container 22. Fluid to be consumed is poured into the flexible bag 16 and casing 12. When the desired amount of fluid to be consumed has been placed into the fluid container 22, the mouthpiece 24 is replaced atop the upper first end of the casing 14. With the base 46 removed, the flexible bag 16 is manually squeezed, while holding the drink dispenser 10 upright, to force the fluid level of the fluid to be consumed upwardly toward the end of the nipple 34. This serves to remove all air from the space between the nipple 34 and the fluid to be consumed. As illustrated in FIG. 4, a one-way valve 58 is formed in the nipple 34 by means of a cross-slit so that air and fluid may exit the fluid container 22 while preventing air from entering the fluid container 22. Once the air is removed, the base 46 may be reattached onto the casing 12.

As the fluid is removed from the drink dispenser 10 by sucking on the nipple 34, the fluid bag 16 further collapses upon itself and travels towards the casing 12. As described above, as the fluid is further removed the fluid bag 16 collapses into the casing 12 until the flexible bag 16 is completely disposed within the casing 12 and the fluid is completely removed from the drink dispenser 10. As can be appreciated by the reader, the flexible bag 16 will not extend away from the casing 12 when the partially filled drink dispenser 10 is placed upright during feeding breaks as the one-way valve 58 in the nipple 34 prevents the entry of air into the fluid container 22. Thus, a negative pressure is created within the fluid container 22 which causes the flexible bag 16 to remain in an increasingly collapsed position until all of the fluid is removed. In contrast with existing bottles, the infant does not ingest air during feeding as the air is expelled before feeding and air has not entered the fluid container 22 during feeding. Therefore, the infant does not experience indigestion due to air intake.

As is shown in the exploded view of FIG. 3, the drink dispenser 10 is easily disassembled into its various components to facilitate cleaning. As opposed to the disposable flexible liners of other bottles, the durable flexible bag 16 can be cleaned and reused, which reduces the cost of using the drink dispenser 10 and eliminates the inconvenience of purchasing disposable liners.

Figure 5:
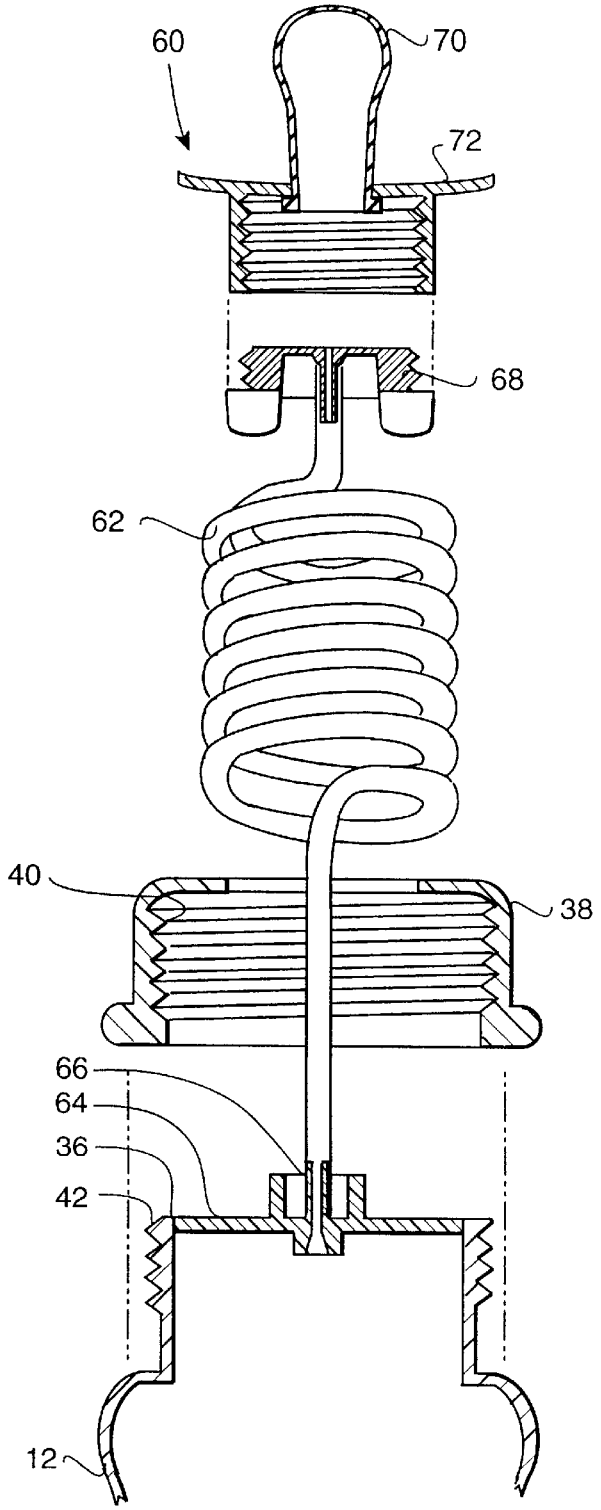
FIG. 5 is a partially exploded and cross-sectional view of another embodiment of the present invention illustrating the drink dispenser of FIG. 1 having the nipple and cap replaced with a mouthpiece having elongated tubing.

Referring now to FIG. 5, another form of the invention is illustrated wherein a modified mouthpiece 60 is in fluid flow communication with the drink dispenser 10 via a hollow tube 62. A generally circular cap 64 coated with latex rests on the upper casing opening 14 and includes a central flow port 66 to which one end of the hollow and flexible tube 62 is secured by friction fit. The ring 38 is threaded onto the drink dispenser 10 so as to compressibly secure the cap 64 to the drink dispenser 10. The hollow tube 62 extends from the cap 64 and beyond the attached ring 38 to a distance determined by the length of the tube 62. An opposite end of the hollow tube is connected to an outlet port 68 which is threadably received into the modified mouthpiece 60. The mouthpiece 60 includes a nipple 70 fixed to a mouth guard 72. The mouthpiece 60 is hollow so that the infant can remove fluid from the drink dispenser 10 through the tube 62 and the nipple 70. The nipple 70 preferably includes a slit one-way valve 58, as illustrated in FIG. 4, so that air is not drawn into the drink dispenser 10.

In use, the drink dispenser 10 is filled and then the cap 64 is placed over the upper casing opening 14 and the ring 38 screwed on tightly over the cap 64. The hollow tube 62 is interconnected between the cap 64 and the outlet port 68 which is attached to the modified mouthpiece 60. Excess air is removed as described above. The drink dispenser 10 can be placed at a convenient location at a distance which allows the length of the hollow tube 62 to stretch between the drink dispenser 10 and the infant's mouth. The infant can suck on the modified mouthpiece 60 in a similar fashion as a pacifier in order to remove the fluid within the drink dispenser 10 through the tube 62 and the mouthpiece 60.

From the foregoing it will be appreciated that the present invention provides a convenient drink dispenser 10 wherein unwanted air within the dispenser 10 may be easily removed to permit fluid to be consumed therein to be easily and smoothly withdrawn, such as by sucking on an appropriate mouthpiece 24 or 60. The amount of fluid to be consumed may be easily read on the exterior of the drink dispenser 10.

Although several embodiments of the invention have been described in detail for purposes of illustration, various modifications of each may be made without departing from the spirit and scope of the invention. Accordingly, the invention is not to be limited, except as by the appended claims.

I claim:

1. A drink dispenser, comprising:

a rigid tubular casing having a first threaded end and an opposite second end;

a flexible bag having an open end attachable to the second end of the casing such that the rigid casing and the flexible bag cooperatively form a fluid container, wherein the rigid casing and the flexible bag each defines approximately one-half of the fluid capacity of the fluid container and the flexible bag is adapted to extend away from the casing when filled with fluid, and fully collapsed into the casing as the fluid is withdrawn therefrom;

a mouthpiece attachable to the first end of the casing to provide an exit passageway for the fluid within the fluid container;

a base which removably snap-fits to the casing to encapsulate the flexible bag; and an air vent between the casing and the base.

2. The drink dispenser of claim 1, including a locking ring engaging the second end of the casing for removably securing the flexible bag thereto.

3. The drink dispenser of claim 2, wherein the locking ring threadably engages the second end of the casing.

4. The drink dispenser of claim 1, wherein the mouthpiece is attached to the casing with a cap mounted over the first end of the casing, the cap including a flow port.

5. The drink dispenser of claim 4, including an elongated flow tube extending between the cap and the mouthpiece.

6. The drink dispenser of claim 1, wherein a surface of the casing is contoured to provide the air vent between the casing and the attached base.

7. The drink dispenser of claim 1, wherein a bottom surface of the base includes an aperture.

8. The drink dispenser of claim 1, wherein the mouthpiece includes a nipple having a one-way valve which prevents air from entering the fluid container.

9. The drink dispenser of claim 8, including means for expelling air between the valve and the fluid within the fluid container.

10. The drink dispenser of claim 9, wherein the expelling means comprises pressure exerted upon the flexible bag.

11. A drink dispenser, comprising:

a rigid tubular casing having a first threaded end and an opposite second end;

a flexible bag having an open end attachable to the second end of the casing such that the rigid casing and the flexible bag cooperatively form a fluid container, wherein the rigid casing and the flexible bag each defines approximately one-half of the fluid capacity of the fluid container and the flexible bag is adapted to extend away from the casing when filled with fluid, and fully collapsed into the casing as the fluid is withdrawn therefrom;

a base which removably snap-fits to the casing to encapsulate the flexible bag;

a mouthpiece attachable to the first end of the casing to provide an exit passageway for the fluid within the fluid container, the mouthpiece including a nipple having a one-way valve which prevents air from entering the fluid container; and a locking ring engaging the second end of the casing for removably securing the flexible bag thereto.

12. The drink dispenser of claim 11, wherein the locking ring threadably engages the second end of the casing.

13. The drink dispenser of claim 11, wherein a surface of the casing is contoured to provide the air vent between the casing and the attached base.

14. The drink dispenser of claim 11 wherein a bottom surface of the base includes an aperture.

15. The drink dispenser of claim 11, including expelling means comprising pressure exerted upon the flexible bag for expelling air between the valve and the fluid within the fluid container.

16. The drink dispenser of claim 11, including an elongated flow tube extending between the mouthpiece and a flow port of a cap mounted over the first end of the casing.

17. A drink dispenser, comprising:

a rigid tubular casing having a first threaded end and an opposite second end;

a flexible bag having an open end attachable to the second end of the casing such that the rigid casing and the flexible bag cooperatively form a fluid container, wherein the rigid casing and the flexible bag each defines approximately one-half of the fluid capacity of the fluid container and the flexible bag is adapted to extend away from the casing when filled with fluid, and fully collapsed into the casing as the fluid is withdrawn therefrom;

a locking ring engaging the second end of the casing for removably securing the flexible bag thereto;

a base which removably snap-fits to the casing to encapsulate the flexible bag;

a mouthpiece attachable to the first end of the casing to provide an exit passageway for the fluid within the fluid container, the mouthpiece including a nipple having a one-way valve which prevents air from entering the fluid container; and expelling means comprising pressure exerted upon the flexible bag for expelling air between the valve and the fluid within the fluid container.

18. The drink dispenser of claim 17, wherein the locking ring threadably engages the second end of the casing.

19. The drink dispenser of claim 17, wherein a surface of the casing is contoured to provide the air vent between the casing and the attached base.

20. The drink dispenser of claim 17, wherein a bottom surface of the base includes an aperture.

21. The drink dispenser of claim 17, including an elongated flow tube extending between the mouthpiece and a flow port of a cap mounted over the first end of the casing.

22. A drink dispenser, comprising:

a rigid tubular casing having a first threaded end and an opposite second end;

a flexible bag having an open end attachable to the second end of the casing such that the rigid casing and the flexible bag cooperatively form a fluid container, wherein the rigid casing and the flexible bag each defines approximately one-half of the fluid capacity of the fluid container and the flexible bag is adapted to extend away from the casing when filled with fluid, and fully collapsed into the casing as the fluid is withdrawn therefrom;

a base which removably snap-fits to the casing to encapsulate the flexible bag; and a mouthpiece attachable to the first end of the casing to provide an exit passageway for the fluid within the fluid container, the mouthpiece including a nipple having a one-way valve which prevents air from entering the fluid container;

wherein a surface of the casing is contoured to provide the air vent between the casing and the attached base.

* * * * *